United States Patent [19]

Kataoka

[11] Patent Number: 4,634,069

[45] Date of Patent: Jan. 6, 1987

[54] WINDING APPARATUS FOR SHEET STRIP

[76] Inventor: Hiroshi Kataoka, 3686, Sangawacho, Iyomishima-shi, Ehime 799-04, Japan

[21] Appl. No.: 732,826

[22] PCT Filed: Aug. 29, 1984

[86] PCT No.: PCT/JP84/00414

§ 371 Date: Apr. 29, 1985

§ 102(e) Date: Apr. 29, 1985

[87] PCT Pub. No.: WO85/01038

PCT Pub. Date: Mar. 14, 1985

[30] Foreign Application Priority Data

Aug. 29, 1983 [JP] Japan ..... 58-132267[U]

[51] Int. Cl.[4] ..... B65H 18/10; B65H 18/16; B65H 23/16

[52] U.S. Cl. ..... 242/65; 242/75.1; 242/75.51; 242/DIG. 2

[58] Field of Search ..... 242/65, 55, DIG. 2, 242/67.1 R, 75.51, 75.1, 75.2

[56] References Cited

U.S. PATENT DOCUMENTS

| | | | |
|---|---|---|---|
| 1,267,080 | 5/1918 | Judelshon | 242/55 |
| 2,135,668 | 11/1938 | Judelshon | 242/DIG. 2 X |
| 2,777,644 | 1/1957 | Nicholson | 242/65 |
| 3,730,450 | 5/1973 | Hank | 242/75.51 X |
| 3,997,122 | 12/1976 | Helfand | 242/DIG. 2 X |
| 4,489,901 | 12/1984 | Anderson | 242/DIG. 2 X |

*Primary Examiner*—John M. Jillions

*Attorney, Agent, or Firm*—Oblon, Fisher, Spivak, McClelland & Maier

[57] ABSTRACT

An apparatus is disclosed which winds a strip of scrap sheet (S) discharged as from a cutting unit of a sheet winding machine. In the apparatus which winds the strip of sheet on a winding frame (7) while causing the strip of sheet to be reciprocated relative to the winding frame, the strip of scrap sheet is wound up without breakage or slackening by keeping a touch roller (1) in contact with the aforementioned winding frame, causing the touch roller to be rotated at a peripheral speed equal to the discharging speed of the strip of sheet, and adjusting winding torque so as to enable the strip of sheet to be wound with the optimum tension.

3 Claims, 9 Drawing Figures

WINDING APPARATUS FOR SHEET STRIP

FIELD OF THE INVENTION

This invention relates to a winding apparatus for strips of sheet such as the opposite lateral edges of sheet trimmed from a roll of sheet by a cutting unit in a sheet winding machine.

BACKGROUND OF THE INVENTION

When a strip of sheet such as of paper or plastic is wound up in a fixed width by a winding machine, the sheet is generally wound up while the opposite lateral edges of the sheet are cut off as with slitters. In the cutting unit of the winding machine, therefore, narrow strips of waste sheet of irregular width are discharged in a large volume. Since these strips of scrap sheet generally have small width, it has been customary for such strips to be wound up on a winding frame as swung laterally as though they were wire ropes being wound on a winding barrel. In that case, a drive mechanism for the winding frame is set so that the winding frame will be rotated at a speed slightly higher than the speed at which the strips of scrap sheet are discharged, and the excess rotation of the winding frame is absorbed by means of a slip mechanism annexed to the drive mechanism for the winding frame. As a result, proper tension is imparted at all times to the cut strips of scrap sheet which are being wound up.

The winding torque of the winding frame not only generates winding tension but also imparts driving tension to the cut strips of scrap sheet being discharged from the cutting unit of the sheet winding machine. Since the cut strips of scrap sheet, while being wound up, are subject to the inertia such as of the the winding frame provided with a flange and the rolls of the cut strips of scrap sheet being wound up, however, the winding torque cannot promptly respond to variation which may occur in the discharging speed of the cut strips of scrap sheet. Consequently, there ensues the possibility that the cut strips of scrap sheet may break under heavy tension and that the wound rolls may slacken. Further, since the strips of scrap sheet are wound up directly into rolls without being held down to a suitable level by touch rollers, the volume of air entrapped between successive plies of strip of sheet in the rolls can not be controlled. If the volume of air entrapped between successive plies increases in certain portions of such plies, or if the thickness of the strip of scrap sheet varies, even slightly, in certain portions in the length of the sheet, the rolls on the winding frame are finished with an outwardly curved surface, an inwardly curved surface, or an irregularly rising and falling surface. The rolls thus obtained, therefore, are not uniform in diameter in the direction of the axis of the winding frame. Even when the winding torque of the winding frame is retained at a fixed magnitude, such nonuniform diameters of the rolls bring about variation in the driving tension of the strips of scrap sheet and may cause the rolls to slacken or the strips in motion to break.

Particularly, in recent years, the winding of sheet is performed at a high speed, and the sheet winding machine is abruptly started at a high speed and abruptly decelerated. The conventional scrap winding machine used for winding cut strips of scrap sheet, therefore, fails at times to wind the strips by keeping pace with the motion of the scrap of sheet discharged from the sheet winding machine. Thus, there ensues the possibility that the strips of scrap sheet so discharged will break or slacken en route to the rolls growing in diameter on the winding frame and that the broken ends or slackened portions will entangle themselves in the sheet winding machine, making it inevitable to stop not only the scrap winding machine but also the sheet winding machine operated for commercial production.

OBJECTS OF THE INVENTION

An object of this invention, therefore, is to provide a winding apparatus for strips of scrap sheet which, even when used with a sheet winding machine capable of high speed operation, enables the strip of scrap sheet discharged from the sheet winding machine to be wound with a fixed tension at all times uniformly over the entire length of the winding frame without breakage of the strip of scrap sheet even during sudden variations in the speed of the winding machine, as during abrupt starting and abrupt deceleration.

Another object of this invention is to provide a winding apparatus for strips of scrap sheet which permits easy control of the density with which each strip of scrap sheet is wound on the winding frame.

SUMMARY OF THE INVENTION

Specifically, this invention relates to an apparatus for winding a strip of scrap sheet on a winding frame by either causing the strip of scrap sheet in motion to be reciprocated in the axial direction of the winding frame or causing the winding frame to be reciprocated in the axial direction thereof relative to the strip of scrap sheet in motion. The winding apparatus comprises a dancer roller provided with means for detecting variation in the tension of the strip of scrap sheet in motion, a touch roller adapted to advance the strip of scrap sheet led out of the dancer roller to the winding barrel of the aforementioned winding frame while remaining in contact with the roll of scrap sheet being formed on the winding barrel, drive means for rotating the touch roller at a peripheral speed equal to the feeding speed of the strip of scrap sheet in motion, and winding frame rotating means provided with means for adjusting the winding torque. The apparatus, by being so provided with the dancer roller and the touch roller, is enabled to adjust selectively the driving tension of the strip of scrap sheet, the winding torque, and the winding touch pressure so that the strip of scrap sheet will be wound on the winding frame with desired hardness (density) in an even thickness.

BEST MODES OF EMBODYING THE INVENTION

Figure 1:
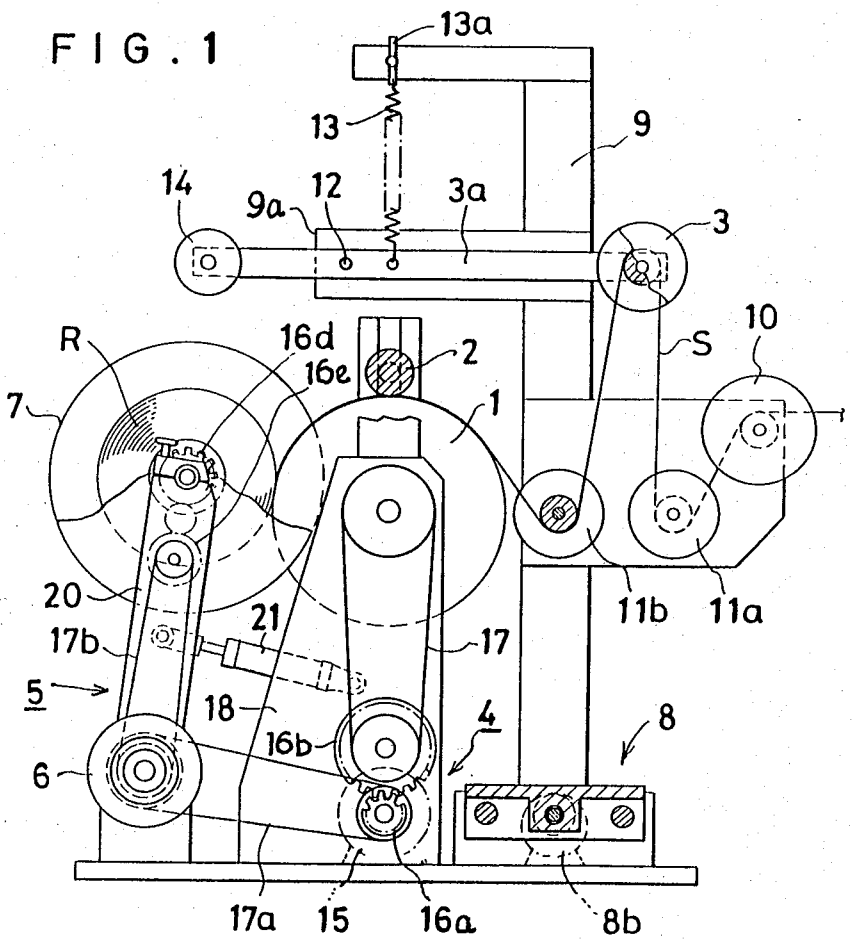
FIG. 1 is a schematic front diagram illustrating a winding apparatus for a strip of scrap sheet as a first embodiment of this invention.

Now, the present invention will be described in detail below with reference to the accompanying drawings.

FIGS. 1–5 illustrate a winding apparatus for a strip of scrap sheet as the first embodiment of this invention. A strip of sheet S cut off the edge of a sheet by a slitter (not shown) of a sheet winding machine and discharged at a speed equal to the driving speed of the sheet is led in from the right end of FIG. 1, passed over guide rollers 10, 11*a*, a dancer roller 3, and a guide roller 11*b*, led to a touch roller 1, and nipped between the touch roller 1 and a nip roller 2. The nip roller 2 and the touch roller 1 jointly draw the strip of sheet S at a speed equal to the discharged speed. The dancer rollers in the present embodiment is illustrated as a flanged roller. Optionally, a roller without a flange or a metallic wire bent in a loop may be used instead.

As a typical example of the strip of sheet for which the winding apparatus of this invention is intended, the scrap sheet cut off either edge of a sheet may be cited. A plurality of such strips of scrap sheet normally discharged from the sheet winding machine are wound up all at once by the apparatus of this invention. The aforementioned scrap sheet for which this invention is intended is not limited to the scrap of the type cut off a sheet as described above. In fact, this invention is applicable to the winding of a strip of sheet of small width.

The guide rollers 10, 11*a*, and 11*b* are supported in place, in conjunction with the dancer roller 3, by a movable frame 9. The movable frame 9 has the lower part thereof threadedly engaged with a threaded bar 8*a* (see FIG. 3) of a laterally reciprocating mechanism 8, so that the movable frame 9 will be reciprocated in the axial direction of the touch roller 1 by causing the threaded bar 8*a* to be rotated alternately in opposite directions by a motor 8*b*.

The dancer roller 3 has a support arm 3*a* thereof pivotally supported by a fulcrum 12 at the end of a horizontal arm 9*a* of the movable frame 9 and is energized upwardly by a spring 13 and a weight 14. So long as the feeding speed of the strip of sheet S is kept equal to the peripheral speed of the touch roller 1, the dancer roller 3 remains in a stationary condition while it is advancing the strip of sheet S to the touch roller 1. In that condition, a DC motor 15 which is the drive source for a touch roller mechanism 4 serving to drive the touch roller 1 through the medium of toothed wheels 16*a* and 16*b* and a belt 17 has its rotating speed controlled. To be more specific, this control of the rotating speed of the motor 15 is effected by transferring the angle of rotation of the support arm 3*a* from the reference position thereof via a toothed wheel 16*c* (see FIG. 4) to a potentiometer 22, there to be converted into a corresponding signal, comparing the signal thus detected with the reference speed signal, and feeding the difference between the two signals as an operating signal to the motor 15. The necessity for the detection mechanism just described may be obviated by replacing the motor 15 with a device capable of mechanically transferring the rotation of the drive system to the touch roller.

The nip roller 2 in the present embodiment is so adapted as to be mounted directly on the touch roller 1 and, solely by its own weight, enabled to press the strip of sheet S against the touch roller 1 tightly enough to prevent slippage of the strip S nipped between the two rollers. A winding frame 7 having a winding barrel 7' is provided adjacent the touch roller 1. The touch roller 1 has a width such that it will come into contact with the entire width of the winding barrel 7' of the winding frame 7. The width of the nip roller 2 is equalized with that of the touch roller 1.

Figure 2:
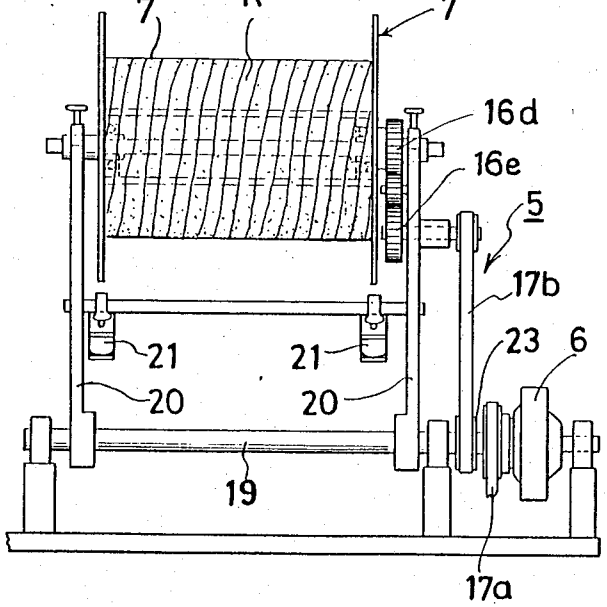
FIG. 2 is a fragmentary left side view of the apparatus of FIG. 1.
Figure 3:
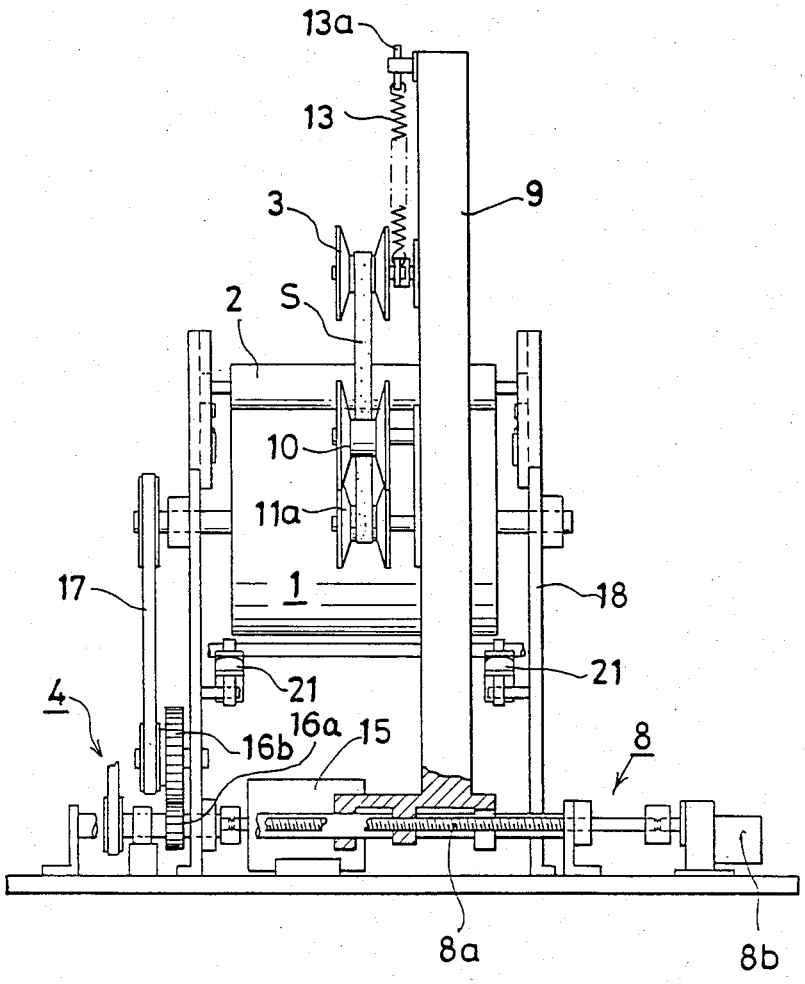
FIG. 3 is a right side view of the apparatus of FIG. 1.
Figure 4:
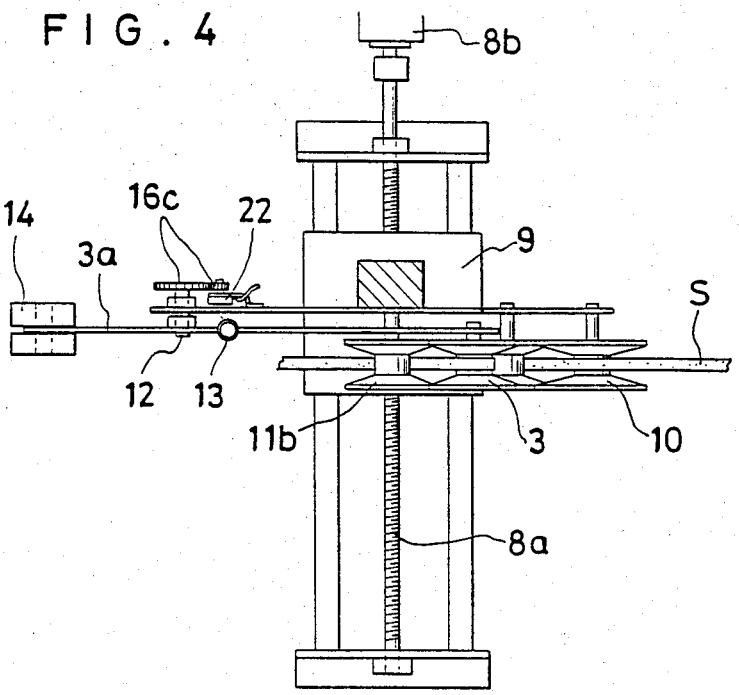
FIG. 4 is a plan view of a movable frame of the apparatus of FIG. 1.
Figure 5:
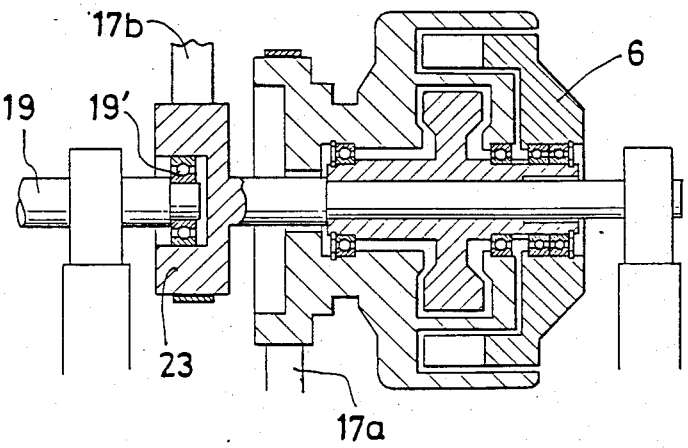
FIG. 5 is a cross section of a magnetic powder clutch to be used as a torque adjusting means for the present invention.
Figure 6:
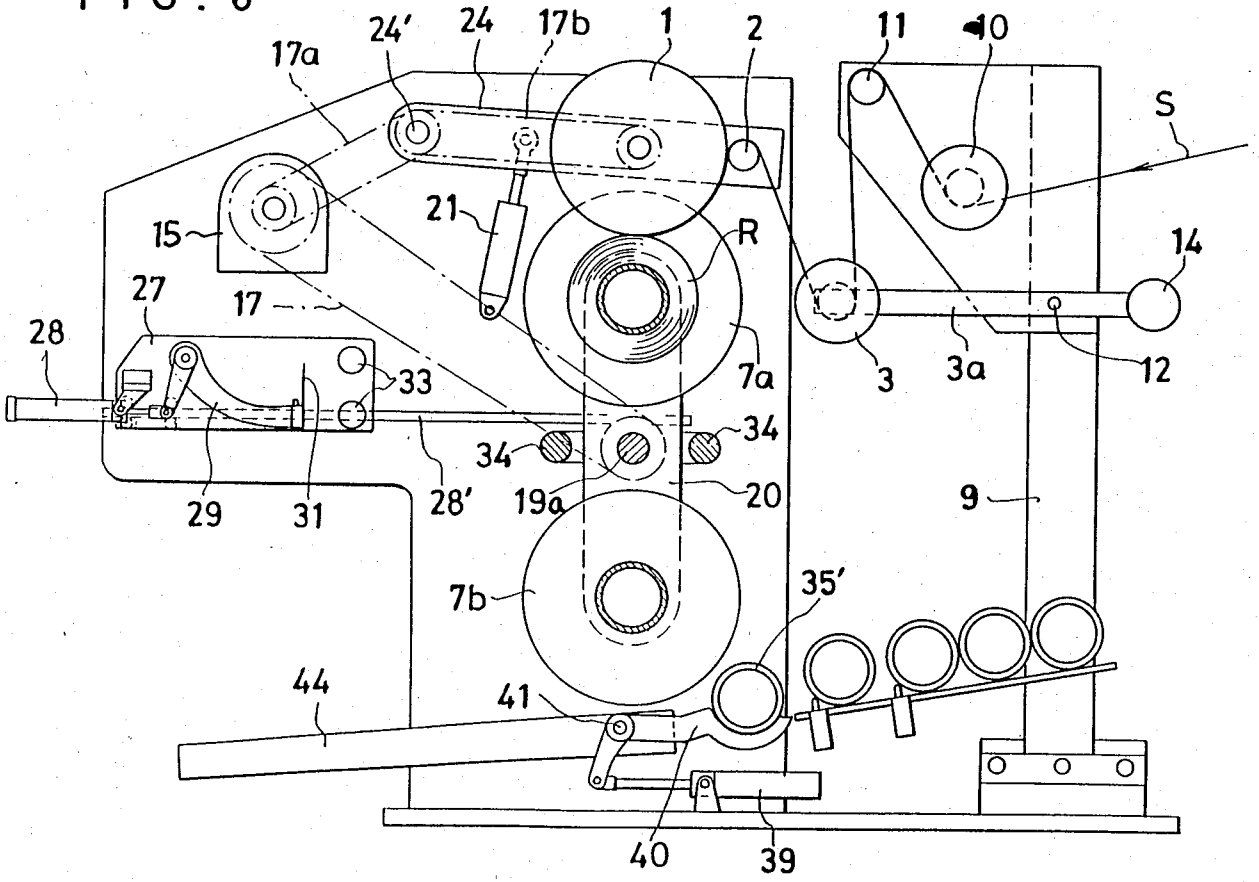
FIG. 6 is a front view illustrating another winding apparatus for a strip of scrap sheet as a second embodiment of the present invention.
Figure 7:
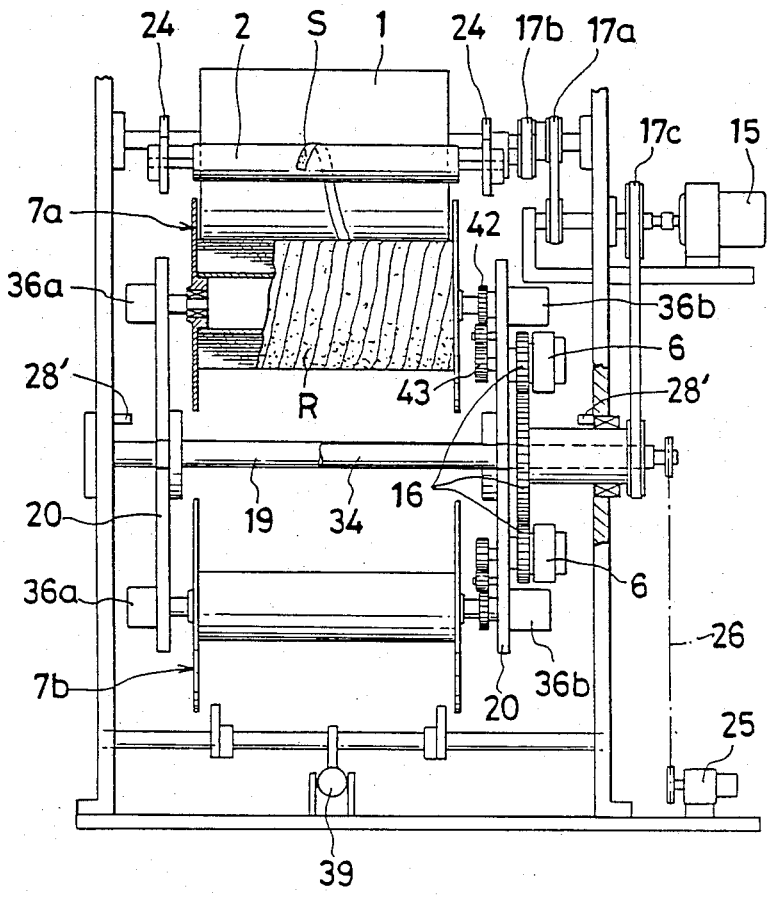
FIG. 7 is a left side view of the apparatus of FIG. 6.

In the present embodiment, the touch roller 1 is rotated at a fixed position on a base 18, and the winding frame 7 is left resting on the touch roller 1. Specifically, the winding frame 7 has the lower end thereof supported by a fulcrum 18 and the upper end thereof detachably supported between the upper ends of a pair of swingable winding arms 20 as illustrated in FIG. 1 and FIG. 2. The pressure with which the arms 20 are pushed against the touch roller 1 is adjusted by a hydraulic cylinder 21.

A rotating mechanism 5 for the winding frame 7 on the arms 20 may rely for its motive force upon some other motor. In the present embodiment, the rotation of the winding frame 7 is effected by transmitting the rotation of the DC motor 15 for driving the touch roller 1 via a belt 6 to a magnetic powder clutch 17*a* disposed on the same shaft as the fulcrum 19 and, as illustrated in detail in FIG. 5, further transmitting this rotation from the output shaft of the magnetic powder clutch 6 via a pulley 23 and a belt 17*b* to the toothed wheels 16*d* and 16*e* which are adapted to rotate the winding frame 7. Since the pulley 23 is supported in place by a bearing 19' which is rotatably attached to the end of the fulcrum 19, the rotation from the clutch 6 is not transmitted to the fulcrum 19. The magnetic powder clutch 6 is utilized as a means of adjusting the torque for the winding torque adjusting device. The winding torque adjusting device is provided with a voltage-adjustable sliding type autotransformer adapted to set a prescribed torque or a device capable of setting the initial winding tension and the ratio for gradual decrease of the winding tension, a device for detecting the amount of the strip of sheet S wound up (the diameter of the roll of the strip of sheet S), and a tension controller. In this arrangement, as the roll R grows in diameter, the torque of the winding frame 7 is adjusted by causing the tension controller to calculate the necessary winding torque signal based on the signal from the aforementioned setting device and the signal from the detecting device, amplify the calculated signal, feeding out the amplified signal, and controlling the exciting current flowing through the coil of the magnetic powder clutch 6 in accordance with the output signal of the tension controller.

Now, the winding motion produced by the apparatus of this invention will be described. The long continuous strip of sheet S discharged from the cutting unit of the sheet winding machine is passed around the guide rollers 10 and 11*a*, the dancer roller 3, and the guide roller 11*b* and then nipped between the nip roller 2 and the touch roller 1, with the leading end of the strip of sheet S attached to the winding barrel 7' of the winding frame 7. By means of the hydraulic cylinder 21, the winding arms 20 are tilted, and the winding barrel 7' of the winding frame 7 is allowed to rest on the touch roller 1 with a prescribed contact pressure. Besides, the energizing force exerted upwardly upon the dancer roller 3 is adjusted in due consideration of the material of the strip of sheet to be wound up and the hardness with which the strip of sheet is to be wound up. This adjustment of the energizing force is effected by turning a screw 13*a* supporting the upper end of the spring 13. Otherwise, the energizing force for the dancer roller may be adjusted by regulating the distance of the support arm 3*a* from the fulcrum 12 of the weight 14. Alternatively, the energizing force for the dancer roller may be adjusted by using a hydraulic cylinder in place of the combination of the spring and the weight. The tension of the strip of sheet can be adjusted by varying the energizing force exerted upon the dancer roller 3 because the strip of sheet produces tension in itself in reaction to the aforementioned energizing force.

As the motors 15, 8*b* are set rotating after completion of the adjustment described above, the touch roller 1 and the winding frame 7 begin to rotate, the movable frame 9 begins to reciprocate in the axial direction of the touch roller 1, and the strip of sheet S begins to wrap itself around the rotating winding frame 7 while reciprocating in the lateral direction. If the tension of the strip of sheets discharged from the sheet winding machine varies for some reason or other and, consequently, the dancer roller 3 is raised, the potentiometer 22 detects the angular displacement and feeds out a corresponding output signal. The motor 15 them increases its own revolution number in accordance with the output signal from the potentiometer 22. Consequently, the peripheral speed of the touch roller 1 is increased over the discharging speed of the strip of sheet enough for the touch roller 1 to return to its stated position. If, conversely, the dancer roller 3 goes down, the output signal from the potentiometer 22 is such as to decrease the revolution number of the motor 15 enough for the dancer roller 3 to return to its stated position. If the tension of the strip of sheets varies so instantaneously that the speed control system of the motor 15 will be unable to follow the variation, the dancer roller 3 responds quickly enough to absorb the instantaneous variation of the tension by changing its position accordingly.

The portion of the strip of sheets which is in motion on the upstream side of the touch roller 1 can impart stable traveling stress to the strip of sheets in accordance with the magnitude of the energizing force exerted upon the dancer roller 3 which ranges from extremely low tension to high tension. Consequently, the touch roller 1 performs the work of drawing out the strip of sheet S by keeping pace with the discharging speed of the strip of sheets and the winding frame 7 continues to wind therein the strip of sheets at the optimum winding torque by virtue of the magnetic powder clutch 6. Owing to the magnetic powder clutch 6, which is capable of varying the output torque, the winding frame 7 is enabled to continue winding the strip of sheets with the required winding torque. While the winding frame 7 is winding the strip of sheets, the hydraulic cylinder 21 adjusts its pressure so that the winding frame 7 will be left resting on the touch roller 1 with the required force. In order to constantly retain the required contact pressure between the touch roller 1 and the roll R as described above, the force for mutual pressure may be produced by the use of a spring or weight instead of the hydraulic cylinder 21. Since the roll R is kept pressed against the touch roller 1, the winding tension exerted upon the strip of sheets being wound on the winding frame 7 may be different from the tension imparted to the portion of the strip of sheets in motion on the upstream side of the touch roller 1.

Unnecessary forced stoppage of the sheet winding machine may be prevented by following the practice of examining the size of the roll R formed on the winding frame 7 of the apparatus for winding a strip of scrap sheet whenever the sheet winding machine is stopped and replacing the winding frame 7 with a new one when necessary.

Where the two strips of scrap sheet being wound outside the opposite edges of the sheet winding machine are required to be removed out of the range of the stroke of the automatic cutting unit of the sheet winding machine and prevented from being cut apart at the time that the trailing end of a sheet roll is slit in the direction of width of the sheet by the cutting unit, the desired removal of the strips of scrap sheet from the aforementioned range of the stroke of the cutting unit can be easily attained by displacing the dancer roller 3 with a pull to be given from the sheet winding machine side instead of causing the strips of scrap sheet to be loosened from the winding frame 7.

Since, in the apparatus for winding a strip of scrap sheet on the winding frame by causing the strip to be laterally reciprocated relative to the winding frame, this invention incorporates the touch roller 1 for the purpose of imparting proper traveling tension to the strip of sheet and enabling the strip to be wound on the winding frame 7 with winding torque such as to produce the optimum winding tension as described above, the invention gives a perfect solution to the problem of the conventional apparatus that the strip of scrap sheet which is wound up by being simply drawing out entraps large volume of air between adjacent plies of sheet in the roll, forms wrinkles and folds in the portion of the sheet being passed around the guide rollers, and gives rise to a roll finished with an outwardly curved surface, inwardly curved surface, or irregularly rising and falling surface, or the strip of scrap sheet breaks, slackens, or entangles because of variation in the tension of the strip of sheet in motion under the influence of the inertia generated by the winding frame. Since the surface of the roll of strip of the scrap sheet which has been wound up with the optimum tension produced by the freely adjustable winding torque is pressed down with the touch roller 1 during the course of the winding, the strip of sheet can be wound tightly and substantially uniformly without giving birth to irregular rise and fall in the surface of the finished roll. Since the rotation of the winding frame is subjected to the braking effect brought about by the friction between the touch roller 1 and the roll of the strip of scrap sheet, it is liberated from the influence of the inertia generated by the winding frame 7. Further, since the traveling tension, the winding torque, and the winding touch pressure of the strip of scrap sheet are independently adjustable, the tightness with which the strip of scrap sheet is wound into the roll R can be freely selected, and the winding apparatus itself can amply cooperate with the sheet winding machine of high-speed operation.

FIG. 6 through FIG. 9 illustrate a winding apparatus for a strip of scrap sheet as the second embodiment of this invention. This winding apparatus has two winding frames attached to winding arms, and the contact pressure of the touch roller against the winding frames is controlled on the touch roller side. The strip of sheet S is passed around guide rollers 10, 11 and a dancer roller 3 disposed on a movable frame 9, led into the boundary between a nip roller 2 and a touch roller 1, and wound up on a winding frame 7*a*. The movable frame 9 is adapted, similarly to the countertype of the first embodiment, to be reciprocated in the axial direction of the touch roller 1. The touch roller 1 and the nip roller 2 are rotatably supported by a horizontal arm 24 rotatably supported by a shaft 24' as a fulcrum. The nip roller 2 is energized against the touch roller 1 by a suitable means.

Two winding frames 7*a*, 7*b* are supported one each at the opposite ends between a pair of winding arms 20. The winding arms 20 are adapted to be rotated about a support shaft 19*a* so that, while one frame 7*a* is winding up the strip of sheet S, the other winding frame 7*b* is kept at rest so as to permit removal therefrom of a core on which the strip of sheet has been wound up to full size and attachment of a new core thereto.

To be more specific, the rotation of a motor 15 (FIG. 7) is transmitted through belts 17*a*, 17*b* to the touch roller 1. Consequently, the touch roller 1 in cooperation with the nip roller 2 draws out the strip of sheet at a speed equal to the discharging speed of the strip of sheet. During the course of the winding, the contact pressure which the touch roller 1 exerts upon the roll R of strip of sheet within the winding frames is adjusted by a hydraulic cylinder 21.

Figure 8:
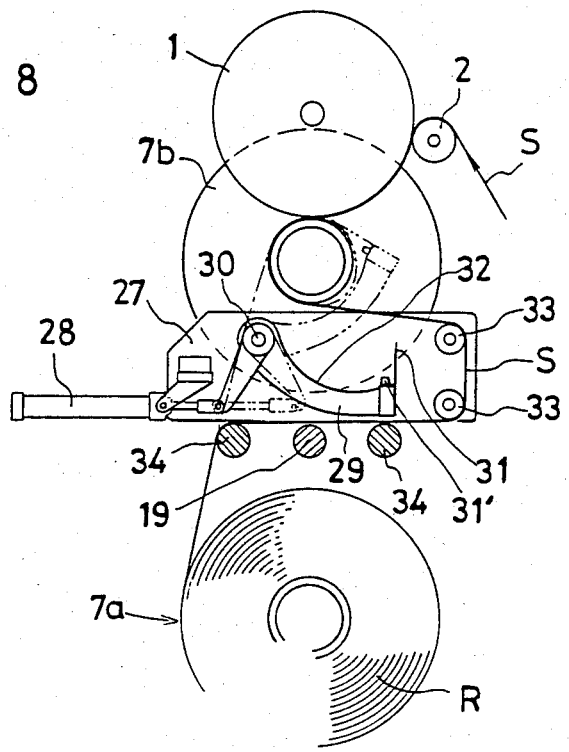
FIG. 8 is an explanatory diagram illustrating the state in which the strip of scrap sheet is cut and wound in the apparatus of FIG. 6.
Figure 9:
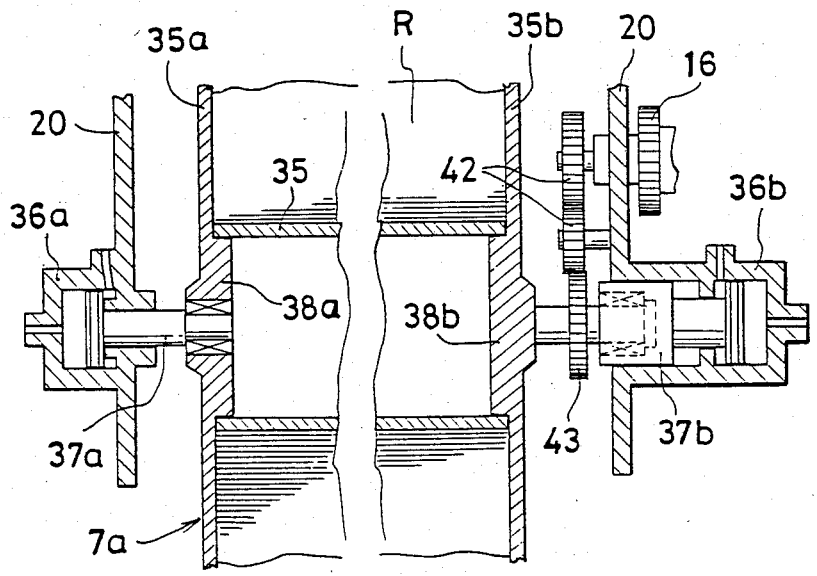
FIG. 9 is a cross section illustrating the state in which a winding frame is constructed.

By the rotation of the motor 15 which is transmitted through the belt 17*c*, a group of toothed wheels 16, 42, and 43, and a magnetic powder clutch 6 to the winding frames 7*a*, 7*b* on the winding arms 20, the winding frames 7*a*, 7*b* are operated with winding torque suitable for producing rotation at a speed equal to the feeding speed of the strip of sheet. The strip of sheet S is consequently wound up evenly on the winding frame 7*a* as described above. When the roll R of strip of sheet thus formed on the winding frame 7*a* grows so much as to reach a prescribed diameter, this state of maturity of diameter is detected by a suitable method, and a signal indicative of this state is transmitted to set a motor 25 rotating. The rotation of the motor 25 is transmitted to a belt 26, with the result that the winding arms 20 are rotated by 180°. Subsequently, a cutting and winding device 27 is moved along a rail 28' and brought to a place directly under the winding frame 7*b* (the means for this movement is not shown in the diagram). As a result, the strip of sheet S is passed around guide rollers 33 disposed at the leading end of the cutting and winding device 27 and around guide rollers 34 supported on the winding arms 20 and wound up on the winding frame 7*a* disposed below (FIG. 8). In the ensuing condition, a hydraulic cylinder 28 of the cutting and winding device 27 is set operating. The consequence is that an arm 29 is rotated about a shaft 30 as a fulcrum as illustrated by the chain line, a blade 31 fixed at the leading end of the arm 29 slits the strip of sheet traveling above, a current of air is started through a hole 31' provided on the inner side of the blade 31, the severed end of the strip of sheet is wound up around the winding frame 7*a* and, at the same time, the leading end of the strip of sheet is led along a curved surface 32 of the arm 29 and wound around the winding barrel of the winding frame 7*b*. After the two severed ends of the strip of sheet have been wound around the respective winding frames 7*a*, 7*b* as described above, the cutting and winding device 27 is retracted to its original position.

The winding frame 7*a* on which the strip of sheet has been wound to the prescribed diameter is moved downwardly by the rotation of the winding arm at an angle of 180°. The winding frame 7*a* comprises two flanges 35*a*, 35*b* and a winding barrel (winding core) 35 having the opposite ends thereof fitted to projected portions 38*a*, 38*b* of the aforementioned flanges 35*a*, 35*b*. The flange 35*a* is connected to a piston 37*a* of a cylinder 36*a* disposed on one of the winding arms 20. The flange 35*b* is rotatably connected to a piston 37*b* of a cylinder 36*b* provided on the other winding arm 20. When the cylinders 36*a*, 36*b* are simultaneously actuated so as to effect retraction of the pistons 37*a*, 37*b*, therefore, the projected portions 38*a*, 38*b* of the flanges 35*a*, 35*b* are pulled out of the winding barrel 35. The winding barrel 35 wrapped in the roll of strip of sheet then falls down onto a conveying base 44 to be transported.

Then, by actuating a cylinder 39 disposed below the winding arms 20 and thereby rotating a winding core feed arm 40 around a shaft 41 as a fulcrum, placing a new winding barrel 35' supported on an arm in the middle of the flanges 35*a*, 35*b*, and again actuating the cylinders 36*a*, 36*b* and thereby driving the projected portions 38*a*, 38*b* into the new winding barrel 35' through the opposite ends thereof, the new winding barrel 35' is fixed by the flanges 35*a* and 35*b* and, thus, is readied to be used as a winding frame. If the projected portion 38*b* of the flange 35*b* is provided around the periphery thereof with winding core retaining means (not shown) to permit transfer of the winding torque via a toothed wheel 42 to a toothed wheel 43, then the rotating torque will be generated also in the winding barrel.

In the winding apparatus of the present embodiment, the strip of sheet can be wound up continuously.

The second embodiment described above represents a winding apparatus so constructed that either of the winding frame and the touch roller remains in a movable state and the other remains in a fixed position while carrying out the work of winding the strip of sheet. Optionally, this invention is applicable to a winding apparatus so constructed that both the touch roller and the winding frame are movably supported, the winding frame is moved backwardly with the growth of the roll in order for the touch roller to be retained substantially at a fixed position while carrying out the work of winding and for the touch roller energized in the direction of the winding frame to be pressed against the surface of the roll. The support arm for the touch roller or the winding frame which is required to remain movable is not limited to the type having one end thereof pivotally supported, but may be of the type adapted to be linearly moved as guided. Further, the present invention is applicable, not merely to a winding apparatus so constructed as to reciprocate the strip of sheet in motion in the axial direction of the winding frame, but equally to a winding apparatus so constructed as to move the winding frame in the axial direction thereof relative to the strip of sheet in motion.

COMMERCIAL FEASIBILITY OF THE INVENTION

The apparatus of the present invention for winding a strip of scrap sheet is capable of winding the strip of scrap sheet under the optimum conditions at all times by quickly responding to possible variation in the discharging speed of the strip of sheet being discharged from a sheet winding machine as described above. It is, therefore, useful for winding any strip of scrap sheet discharged from a sheet winding machine operated at a high speed or from a winding machine handling readily breakable sheet such as paper. The modified version of the winding apparatus of this invention is capable of substantially continuous winding operation in spite of the limited roll size and, therefore, is suitable for use with a sheet winding machine which by nature discharges the strip of scrap sheet in huge volume.

What is claimed is:

1. Apparatus for winding into a roll a strip of scrap sheet fed to the apparatus at a speed which represents the output of another device, said apparatus comprising:

(a) a winding frame comprising a winding barrel on which, during use of the apparatus, a strip of scrap sheet is wound, and opposite flanges;

(b) a first means for detecting variations in the tension of the strip of scrap sheet at it is fed to said winding frame, said first means comprising a dancer roller which, during use of the apparatus, operatively engages the strip of scrap sheet as it is fed to said winding frame;

(c) a touch roller which, during use of the apparatus:

(i) operatively engages the strip of scrap sheet downstream of said dancer roller and advances it toward said winding frame and (ii) bears against the roll being wound on said winding barrel;

(d) a second means for adjusting the pressure of contact between said touch roller and a roll being wound on said winding barrel;

(e) a drive means for rotating said touch roller at a peripheral speed controlled by the tension variations detected by said first means to be equal to the speed at which the strip of scrap sheet is being fed to the apparatus; and (f) a winding barrel rotating means provided with a third means for adjusting the winding torque during the winding of the strip of scrap sheet onto said winding barrel.

2. Apparatus as recited in claim 1 wherein said first means comprise a potentiometer which delivers an electric signal to said drive means and thereby effects control of the peripheral speed of said touch roller.

3. Apparatus as recited in claim 1 wherein:

(a) said touch roller is interposed between said opposite flanges of said winding frame and (b) said touch roller is held in contact with said winding barrel of said winding frame over the entire width thereof.

* * * * *